United States Patent [19]

Andrews

[11] Patent Number: 4,693,291

[45] Date of Patent: Sep. 15, 1987

[54] CURTAIN-HOOK ASSEMBLY

[76] Inventor: Linda S. Andrews, 3003 W. Lincolnshire, Toledo, Ohio 43606

[21] Appl. No.: 816,640

[22] Filed: Jan. 6, 1986

[51] Int. Cl.[4] ..... A47H 15/00; A47H 13/02

[52] U.S. Cl. ..... 160/388; 160/330

[58] Field of Search ..... 160/DIG. 6, 123, 124, 160/126, 330, 340, 388, 389, 398; 4/608, 610; 24/690; 211/124, 330

[56] References Cited

U.S. PATENT DOCUMENTS

| | | | |
|---|---|---|---|
| 655,982 | 8/1900 | Mathewson | 24/599 |
| 679,394 | 7/1901 | Nyhus | 24/690 |
| 2,410,662 | 11/1946 | Kahn | 160/124 |
| 2,859,810 | 11/1958 | Sachs | 160/124 |
| 4,120,343 | 10/1978 | Wilson | 160/330 |
| 4,126,172 | 11/1978 | Faragher, Jr. | 160/330 |

*Primary Examiner*—J. Franklin Foss
*Assistant Examiner*—Cherney S. Lieberman
*Attorney, Agent, or Firm*—David C. Purdue

[57] ABSTRACT

An assembly of a plurality of hooks with a particular curtain structure is disclosed. The curtain structure includes straps which extend from an edge of a curtain and a fabric layer attached to the curtain in the vicinity of each strap. Each hook has first and second spaced legs which depend from a web, and a third leg which depends from the web between the first and second legs, and has an upturned free end which constitutes a hook member. The legs of the hooks are supported relative to the curtain by the fabric layer. The straps of the curtain structure have free ends with openings therethrough, and are so sized that the curtain structure can be installed by passing the straps over a suitably mounted rod and slipping the openings in the free ends thereof over the hook members. The hook members are so shaped that, when the curtain is so installed, a second curtain can be installed by slipping openings in the vicinity of its upper edge over the hook members.

3 Claims, 4 Drawing Figures

CURTAIN-HOOK ASSEMBLY

BACKGROUND OF THE INVENTION

1. Field of the Invention

The instant invention is an assembly of a plurality of hooks with a particular curtain structure. The curtain structure includes straps and a fabric member attached to a curtain in the vicinity of each strap. A hook which engages the fabric member is operable to receive in engaging relationship a free end of the strap in its vicinity and to serve as a support for a second curtain.

2. The Prior Art

The instant inventor knows of two U.S. patents which disclose supports that can be used for two different curtains or for a single curtain composed of two different materials. One of these patents, No. 4,120,343, discloses straps having opposed ends coated with a pressure sensitive adhesive and a curtain having a paper side and a water-impervious side, the latter being a coating on a paper sheet or a sheet of polyethylene or the like laminated to a paper sheet. The curtain is supported on a rod by the straps which extend over and partially around the rod so that the pressure sensitive adhesive coatings on the opposed ends contact one another through openings along the upper edge of the curtain. The other of these patents, No. 4,126,172, discloses a structure which comprises two spaced curtains, each supported on its own rod by hooks which are suspended on one of the rods and are received in openings in the upper edge of one of the curtains. The inventor is also familiar with structures similar to that of the '172 patent except that there is only one rod and hooks suspended on that rod are received in openings in the upper edges of both of the curtains.

SUMMARY OF THE INVENTION

The instant invention is an assembly of a plurality of hooks with a particular curtain structure. The curtain structure includes straps which extend from an edge of a curtain and a fabric layer attached to the curtain in the vicinity of each strap. Each hook has first and second spaced legs which depend from a web, and a third leg which depends from the web between the first and second legs, and has an upturned free end which constitutes a hook member. The first and second legs of the hooks are received between the curtain and the fabric layer while the third leg of the hooks is on the opposite side of the fabric layer. The thickness of the fabric layer is such, relative to the spacing among the legs thereof that the hooks are frictionally engaged with the fabric layer. The straps of the curtain structure have free ends with openings therethrough, and are so sized that the curtain structure can be installed by passing the straps over a suitably mounted rod and slipping the openings in the free ends thereof between the hook members and the fabric layer. The hook members are so shaped that, when the curtain is so installed, a second curtain can be installed by slipping openings in the vicinity of its upper edge over the hook members.

DESCRIPTION OF THE PREFERRED EMBODIMENTS

Figure 1:
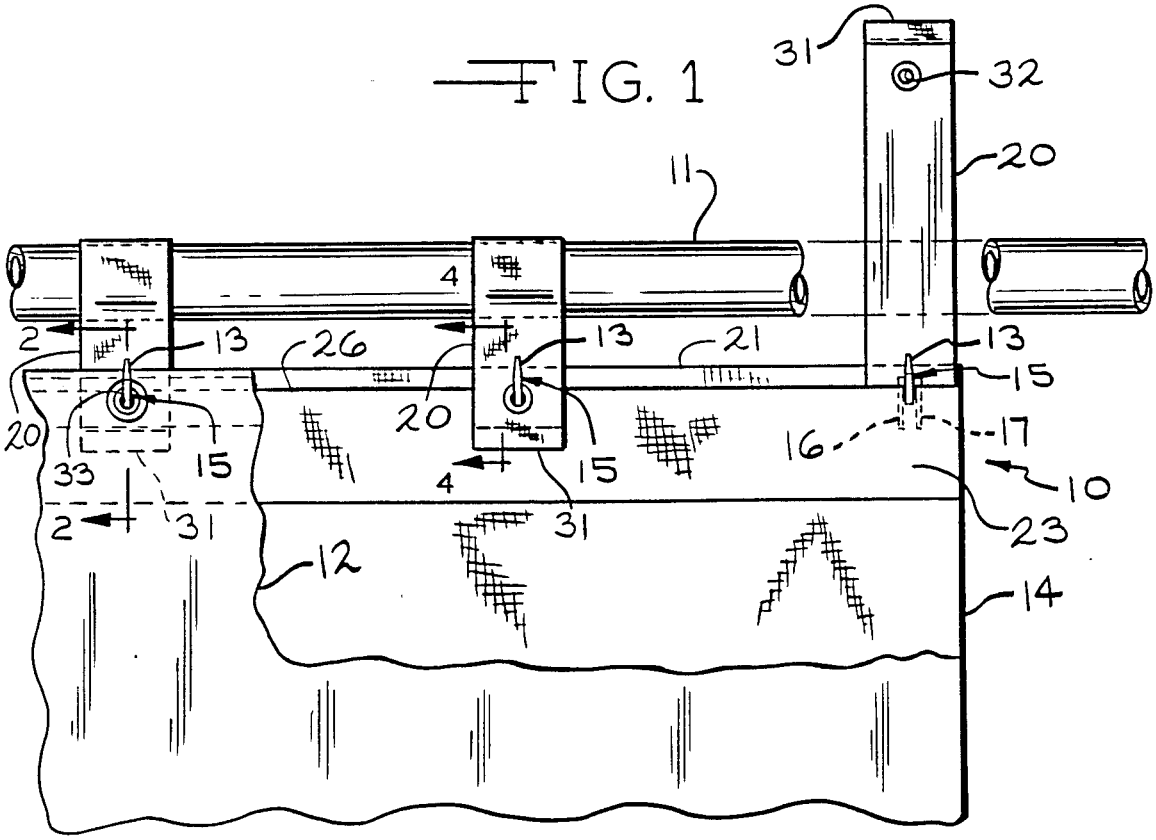
FIG. 1 is a view in vertical elevation of an assembly according to the invention comprising a curtain and a plurality of hooks; the assembly and a second curtain are shown installed, the former relative to a rod and the latter on the hooks of the assembly.

An assembly according to the invention is indicated generally at 10 in FIG. 1, being shown installed on a suitably mounted rod 11, and with a curtain 12 installed on hook members 13. The assembly 10 comprises a curtain 14 and a plurality of hooks indicated generally at 15. The curtain 12 can be a water impervious liner, and the curtain 14 can be a decorative outer curtain.

Figure 3:
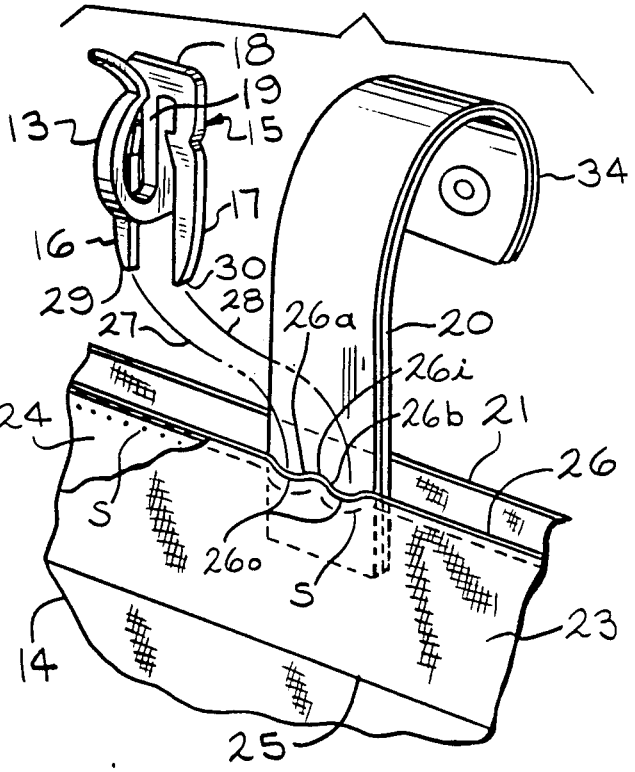
FIG. 3 is an exploded view in perspective showing a fragment of the curtain of an assembly according to the invention and the hook thereof in a disassembled condition.

As better seen in FIG. 3, each of the hooks 15 has a first leg 16 and a second leg 17 which are spaced from one another and which depend from a web 18. Each of the hooks 15 also has a third leg 19 which depends from the web 18 between the first and second legs 16 and 17 and which has an upturned free end that is the hook member 13.

Figure 2:
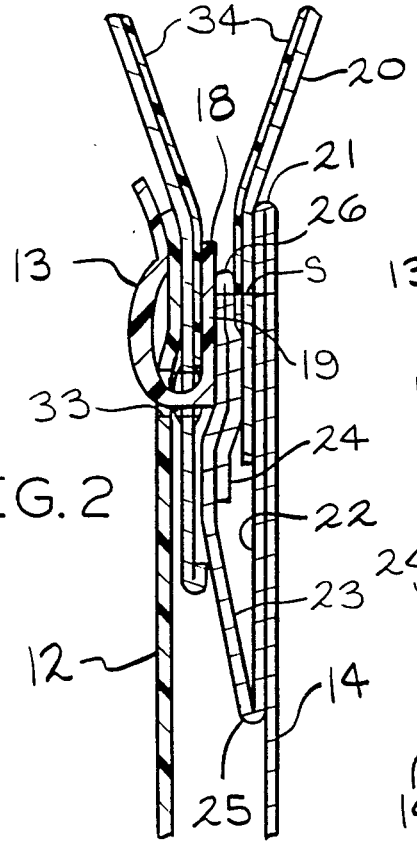
FIG. 2 is a sectional view along the line 2—2 of FIG. 1.

Spaced straps 20 extend from the upper edge 21 of the curtain 14. As best seen in FIG. 2, the fabric of the curtain 14 extends upwardly to the upper edge 21 and then has a terminal folded portion which includes a downwardly extending portion 22, an upwardly extending portion 23 and a downwardly extending portion 24. The terminal folded portion has a bottom 25 at the fold between the portions 22 and 23 and a top 26 at the fold between the portions 23 and 24. In the specific assembly 10 the folded terminal portion of the curtain 14 is stitched, just below the top 26 thereof to the curtain 14; this stitching S also "catches" one end of each of the straps 20, attaching it to the curtain 14 and to the folded terminal portion thereof composed of the portions 22, 23 and 24. The portions 23 and 24 constitute a fabric layer which is stitched to the curtain 14; because of the nature of stitching S , the attachment is at spaced points.

Referring to FIG. 3, the hooks 15 are assembled with the curtain structure just described by moving them as indicated by lines 27 and 28 so that ends 29 and 30 of the legs 16 and 17 are received between the curtain 14 and the fabric layer composed of the curtain portions 23 and 24. In other words, the legs 16 and 17 are moved downwardly so that they are received behind outwardly undulated portions 26o of the top 26 of the folded terminal portion of the curtain 14. As the hooks 15 are moved downwardly, the hook members 13 are urged outwardly so that the leg 19 is outside the portion 23 of the folded terminal portion of the curtain 14. In other words, as the hooks 15 are moved downwardly, the leg 19 moves down outside of an inwardly undulating portion 26i of the top 26 of the folded terminal portion of the curtain 14. Consequently, as shown in FIG. 2, a cross section through the line 2—2 of FIG. 1 and through the leg 19, the leg 19 is to the left of or outside of the fabric layer composed of the portions 23 and 24 of the curtain 14. Downward movement of the hooks 15 is continued until the bottoms of the webs 18 bear against portions **26*a* and 26*b* of the top 26 of the folded terminal portion of the curtain 14. The hooks 15 are made of a resilient material so that the legs 19 are urged into alignment with the legs 16 and 17, engaging the fabric layer composed of the portions 23 and 24 of the curtain 14**.

This relationship is depicted in FIG. 1, on the right-hand side, where legs 16 and 17 are shown in dotted lines because they are behind the curatin portions 23 and 24. The hook member 13, and with it the leg 19 (not visible in FIG. 1 because it is hidden behind the member 13) are in front of the curtain portions 23 and 24.

The assembly of the curtain 14 and the hooks 15 which has just been described can be installed relative to the rod 11 merely by positioning the assembly so that successive ones of the straps 20 extend above the rod 11 (see the strap on the right in FIG. 1), pulling free ends 31 of each of the straps 20 over the rod 11 and slipping metal reinforced openings 32 over the hook members 13. After the assembly of the curtain 14 and the hooks 15 has been installed relative to the rod 11, as just described, the curtain 12 can be installed relative to the assembly merely by slipping plastic reinforced openings 33 in the upper edge thereof over the hook members 13. The straps 20 have a plastic lining 34 which facilitates sliding thereof relative to the rod 11.

Figure 4:
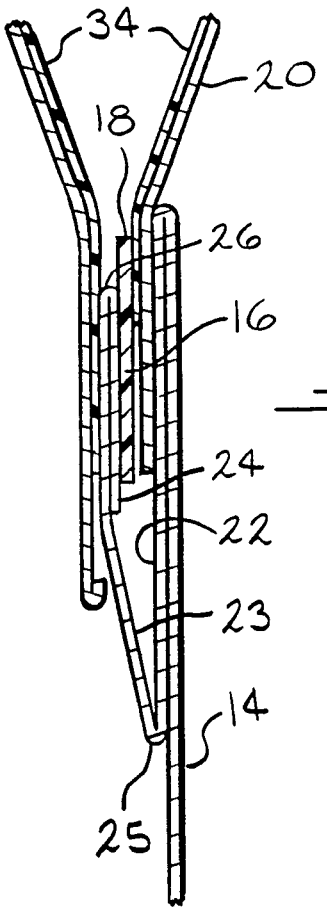
FIG. 4 is a sectional view along the line 4—4 of FIG. 1.

Referring to FIG. 4, a cross-sectional view along the line 4—4 of FIG. 1 and through the leg 16, the leg 16 is shown between the fabric layer composed of the portions 23 and 24 of the curtain 14 and a fabric layer composed of the curtain 14, outwardly extending portion 22 and a portion of the strap 20.

While only a single specific embodiment of the invention, which embodiment constitutes the best mode presently contemplated by the inventor, has been shown in the attached drawings and described with reference thereto, it will be apparent to those skilled in the art that various changes and modifications are possible without departing from the spirit and scope of the invention as defined in the appended claims.

I claim:

1. An assembly comprising a curtain and a plurality of hooks, each of said hooks having downwardly extending leg which has an upturned free end which constitutes a hook member, said curtain having spaced straps attached at one end to and extending from its upper edge, said hooks being secured to said curtain, one hook in alignment with and adjacent to each strap, said straps having free ends with openings therethrough, and being so sized that the curtain can be installed by passing said straps over a suitably mounted rod and slipping the openings in the free end of each over one of said hook members, and the hook members of said hooks being so shaped that, when the curtain is so installed, a second curtain can be installed by slipping openings in the vicinity of its upper edge over the hook members.

2. An assembly comprising a curatin and a plurality of hooks, each of said hooks having first and second spaced legs which depend from a web, a third leg which depends from said web between said first and second legs, and has an upturned free end which constitutes a hook member, said curtain having spaced straps attached at one end to and extending from its upper edge and, aligned with each of said straps, a fabric layer that is attached to said curtain at spaced points in the vicinity of its upper edge, the first and second legs of each of said hooks being received between said curtain and said fabric layer while the third leg of each of said hooks is on the opposite side of said fabric layer, the thickness of said fabric layer being such, relative to the spacing among the legs thereof that said hooks are frictionally engaged relative to said fabric layer, said straps having free ends with openings therethrough, and being so sized that the curtain can be installed by passing said straps over a suitably mounted rod and slipping the openings in the free end of each between the hook member of one of said hooks and said fabric layer, and the hook members of said hooks being so shaped that, when the curtain is so installed, a second curtain can be installed by slipping openings in the vicintiy of its upper edge over the hook members.

3. An assembly as claimed in claim 2 wherein said fabric layer is an integral part of said curtain, and, together with said straps, is stitched to said curtain.

* * * * *